United States Patent [19]

Beretta

[11] Patent Number: 4,601,122

[45] Date of Patent: Jul. 22, 1986

[54] DEVICE FOR THE TIMELY FEEDING OF CARTRIDGES IN SEMI-AUTOMATIC RIFLES

[75] Inventor: Pier G. Beretta, Gardone, Italy

[73] Assignee: Fabrica d'Armi P.Beretta S.p.A., Italy

[21] Appl. No.: 706,714

[22] Filed: Feb. 28, 1985

[30] Foreign Application Priority Data

Mar. 27, 1984 [IT] Italy ..... 5135 A/84

[51] Int. Cl.[4] ..... F41C 5/00

[52] U.S. Cl. ..... 42/21; 42/17

[58] Field of Search ..... 42/21, 17

[56] References Cited

U.S. PATENT DOCUMENTS 984,489 2/1911 Redfield ..... 42/21

*Primary Examiner*—Deborah L. Kyle
*Assistant Examiner*—Michael Carone
*Attorney, Agent, or Firm*—McGlew and Tuttle

[57] ABSTRACT

Disclosed is a device suitable for semi-automatic rifles, and capable of timely feeding cartridges into the firing chamber without causing void loading of the weapon.

The improved device comprises a sliding member controlled by the hammer and cooperating with a trowel-like lift. The device operates so as to position the lift for receiving a fresh cartridge from the magazine in advance of the striking of the firing pin by the hammer.

4 Claims, 6 Drawing Figures

DEVICE FOR THE TIMELY FEEDING OF CARTRIDGES IN SEMI-AUTOMATIC RIFLES

BACKGROUND OF THE INVENTION

Semi-automatic rifles, whether of the gas-operated type, with short or long recoil, or with pumping action are generally provided with a mechanism for feeding a fresh cartridge from the magazine of the weapon and delivering it to the cartridge chamber after the ejection of the cartridge case previously fired and subsequently to the cocking of the hammer.

Such a device comprises, as it is well known, a trowel-like lift which receives from the magazine a cartridge and delivers it subsequently toward the cartridge chamber, and a composite lever which cooperates with the trowel-like lift and changes from a position in which it blocks the cartridges within the magazine to a position in which it allows the passage of a cartridge at a time to the lift in synchronization with the action of the hammer upon the firing pin of the rifle.

One disadvantage is, however, possible with such a mechanism, in that the fresh cartridge might not be positioned timely in the trowel-like body of the lift for the subsequent feeding into the cartridge chamber, due to the recoiling action that follows the firing of a cartridge in the chamber and its ejection from the barrel of the rifle. The recoiling action has, in fact, the tendency of displacing the cartridges in the magazine in a forward direction and, thus, away from the lift, so that the passage of a fresh cartridge to the lift may be oftentimes incomplete or, at least untimely. This is especially true in the case of strong ammunition with consequent violent recoil. What happens then is a cycle of empty loading of the rifle, which finds itself with a cocked hammer, a closed breech block and an empty cartridge chamber, thus rendering the weapon unreliable in its intended use.

BRIEF SUMMARY OF THE INVENTION

It is an object of the present invention to provide an improved device for feeding cartridges to a rifle of the semi-automatic type, which device permits the passage of a cartridge to the trowel-like lift in advance with respect to the action of the hammer on the firing pin and, therefore, before the occurrance of the recoil caused by the firing of a cartridge. In this manner, the recoil which follows the firing of the cartridge, even if it should cause an axial displacement of the ammunition in the magazine, will have no effect upon the cartridge already delivered to the lift. This cartridge will thus be in a condition for safely entering the cartridge chamber when urged by the breech block, following the cocking of the hammer. The possibility of a void loading of the rifle is thus eliminated and the weapon is rendered completely reliable in its operation.

It is another object of the invention to provide an improved deive which is applicable to any semi-automatic rifle, by adopting a single, although composite, lever for controlling the feeding of the cartridges to the rifle which can be of any of the types indicated hereabove, i.e., gas-operated, inertia-operated, with short or long recoil or with a pumping action.

These objects and advantages will become more apparent from the detailed description of the invention presented herein below in conjunction with the accompanying drawings.

DETAILED DESCRIPTION OF THE INVENTION

Figure 1:
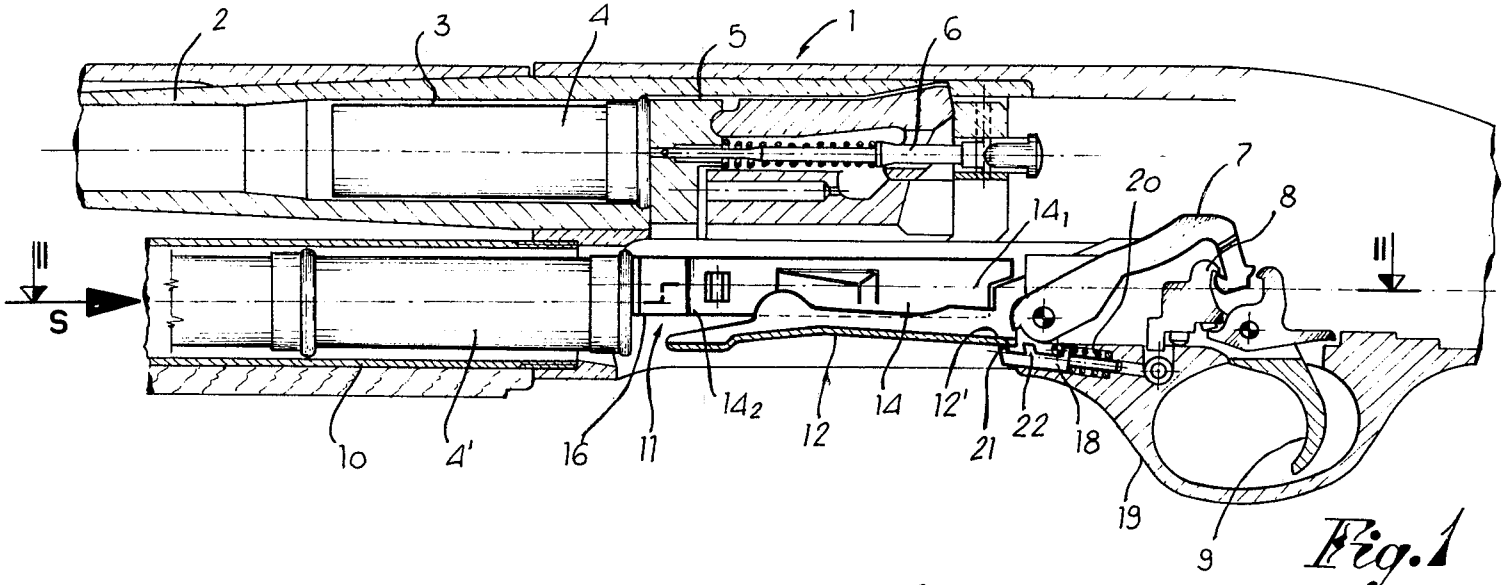
FIG. 1 is a longitudinal sectional view of a section of a rifle with cocked hammer ready for firing a cartridge and with reserve ammunition held in the magazine.

Referring now to the accompanying drawings, numeral 1 indicates in general a semi-automatic rifle which comprises, as it is known, a barrel 2 with cartridge chamber 3, which is to receives a cartridge 4 at a time, a breech block 5 for opening and closing the chamber 3 and carrying a firing pin 6, a hammber 7 actuated by a spring in the direction of arrow F and serving to strike the firing pin, a catch 8 for the hammer 7 when in the cocked position, and a trigger 9 which controls the catch to release the hammer at the specified firing time.

Beneath the barrel 2 extends a magazine 10 for the reserve ammunition 4', displaced in the direction of arrow S by means of a feed spring—not shown—toward a feed chamber 11 within which there is provided and operates a trowel-like lift 12 that serves to receive one cartridge at a time and deliver it to the cartridge chamber 3 when the breech block 5 moves forwardly after having completed the ejection phase of the spent cartridge 4 and, concurrently, having recocked the hammer 7. Within the feed chamber 11, laterally with respect to the lift 12, there is also provided a lever 13 that actuates and controls each time the passage of a cartridge 4' from the magazine 10 to the lift 12. This lever 13 is of the pivot type and comprises a main member 14 pivoting on an intermediate pin 14' and capable of counterpoised displacements contested or opposed by a spring 15, and a blocking member 16 pivoting at 16' and actuated or urged by a spring 17. Member 16 is partially superimposed on the main member 14 and acts against the case of the cartridge 4' which, in the magazine, appears to be facing the feed chamber. The main member 14 of lever 13 cooperates in its rear portion $14_1$ with the lift 12 and, in its front portion $14_2$ with the blocking member 16, so as to displace the latter from a position of axial blockage of the cartridges 4' within the magazine 10 to a position which allows the passage of a fresh cartridge 4' onto the lift 12, as more fully explained hereinbelow.

In the rear portion 12' of the lift, there is associated therewith a sliding member 18, mounted on and guided on the trigger guide 19 and urged by a spring 20. This spring serves to displace in normal fashion the sliding member 18 toward the said rear portion 12' of the lift. The sliding member 18 has a terminal beak 21 which serves to engage the rear portion 12' of the lift, and an intermediate tooth 22 which in turn engages a countertooth 23 provided on the hammer 7.

The basic function of the sliding member 18 is to detect the displacements of the hammer 7 and to allow the placement of the lift 12 in a position of receiving a fresh cartridge 4' from the magazine 10 in advance with respect to the firing of the cartridge 4 in the chamber 3, so as to achieve the purposes of the invention mentioned above.

Figure 2:
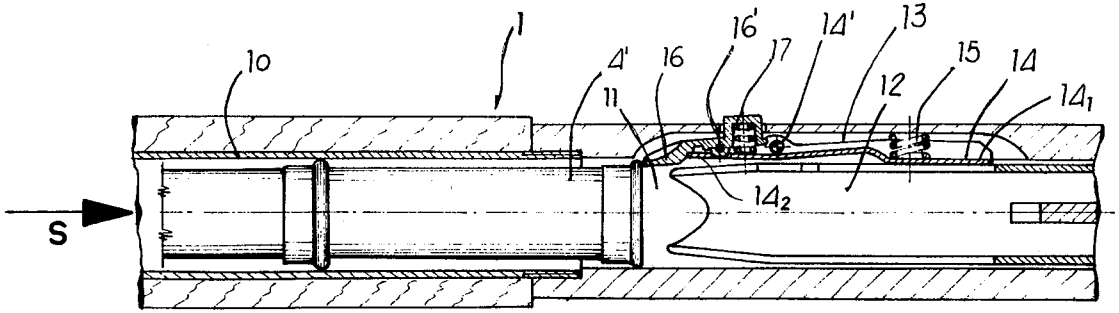
FIG. 2 is a sectional view taken along lines II—II of FIG. 1.

The operation of the rifle is in itself knwn and needs no further explanation. Nevertheless, before the cartridge 4 is fired the hammer 7 is cocked and engaged by the catch 8, and the breech block 5 rests against the cartridge 4, closing the cartridge chamber 3. Such a condition is illustrated in FIGS. 1 and 2 of the accompanying drawings. The sliding member 18 is disengaged from the hammer 7 and pushed forwardly, that is, toward the lift 12 by its spring 20. The terminal beak 21, then, places itself beneath the rear portion 12' of the lift, so as to keep the latter in an intermediate rest position. In this position, the surface of the lift which faces the lever 13 engages against the main member 14 of the lever. The main member 14 is thus positioned so that the blocking member 16 is in turn displaced in a position of interception of the cartridges 4' in the magazine, where they are blocked.

Figure 3:
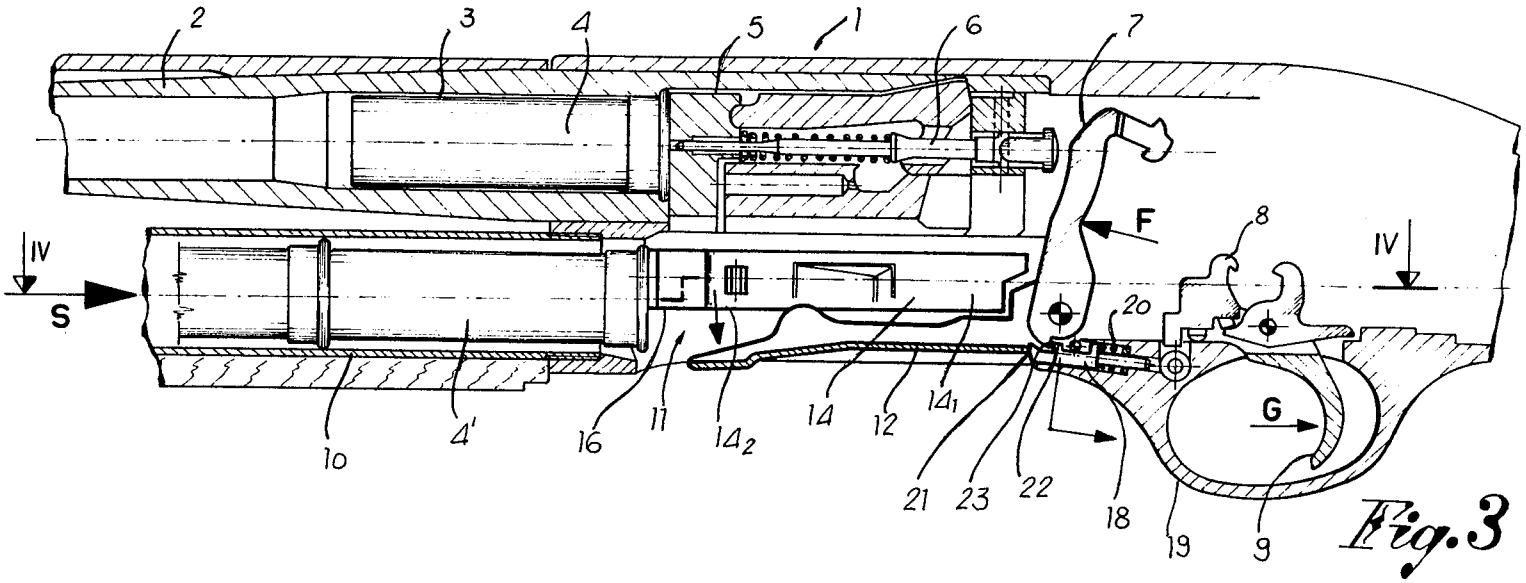
FIG. 3 is another longitudinal sectional view of the rifle, in which the weapon has the hammer disengaged and ready in position for striking the firing pin, and the trowel-like lift is ready to receive a fresh cartridge.
Figure 4:
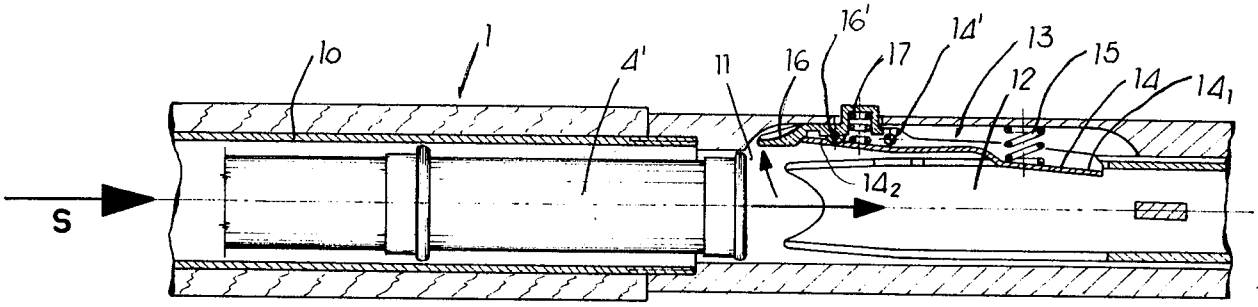
FIG. 4 is a sectional view taken along lines IV—IV of FIG. 3.

At the time of firing the cartridge 4, the hammer becomes disengaged by acting on the trigger 9—see arrow G in FIG. 3—so that the hammer is permitted to strike the firing pin 6. However, always in accordance with the invention, before the hammer strikes the firing pin, the countertooth 23 engages the intermediate tooth 22 of the sliding member 18. To the subsequent further rotation of the hammer 7 corresponds, therefore, a backward movement of the sliding member 18 to a point where the terminal beak 21 of the lever is moved away from the rear portion 12' of the lift 12. Such a transitional condition is illustrated in FIGS. 3 and 4 of the accompanying drawings. To this condition corresponds a downwardly displacement of the lift 12. At this time, the main member 14 of lever 13 is no longer engaged and held by the adjacent surface of the lift, so that it is free to rotate toward the interior of the feed chamber 11 and displace the blocking member 16 laterally and away from the case of the cartridge 4' positioned in the magazine 10 adjacent to the said feed chamber. Thus, the cartridge 4', no longer axially blocked, moves in the direction of arrow S into the feed chamber 11 and comes to rest on the lift 12; all this occurs before the hammer strikes the firing pin 6, so that the feeding of a fresh cartridge is effected in advance of the actual firing of cartridge 4 in the cartridge chamber of the barrel 2.

Figure 5:
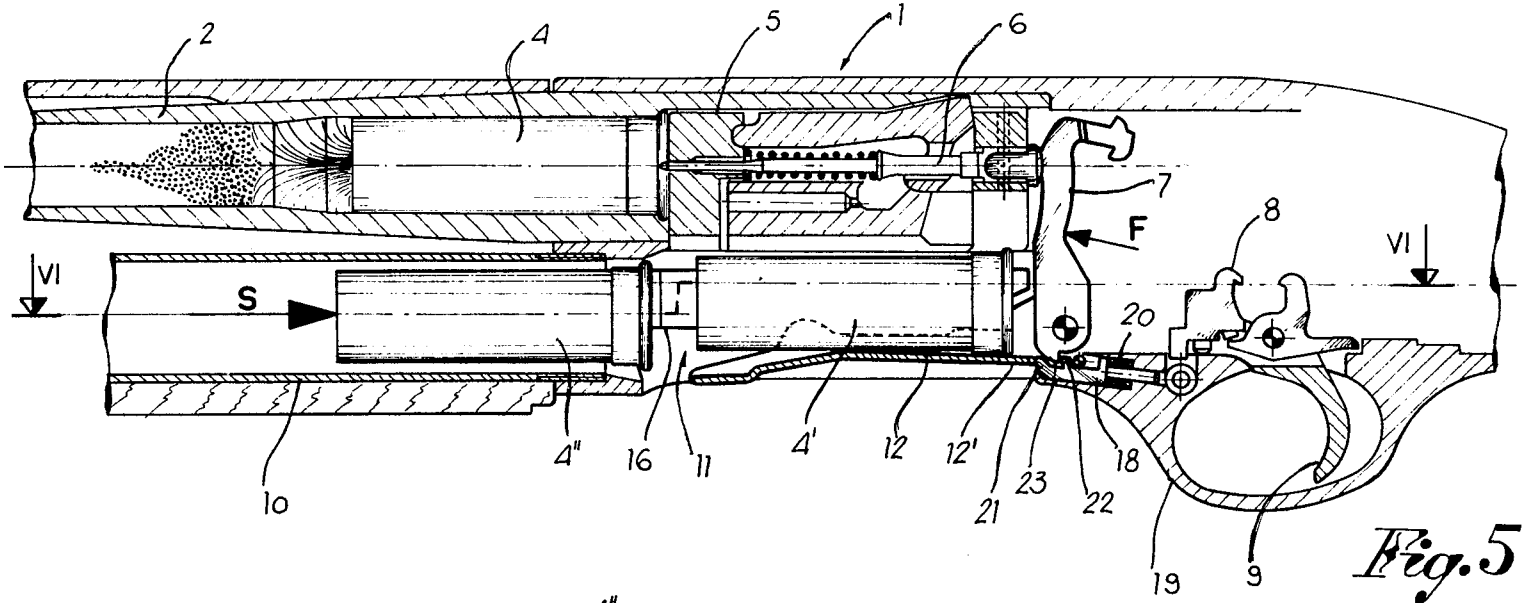
FIG. 5 is still another longitudinal sectional view of the rifle, in which the weapon is in position of firing the cartridge when the fresh cartridge is already positioned on the lift.
Figure 6:
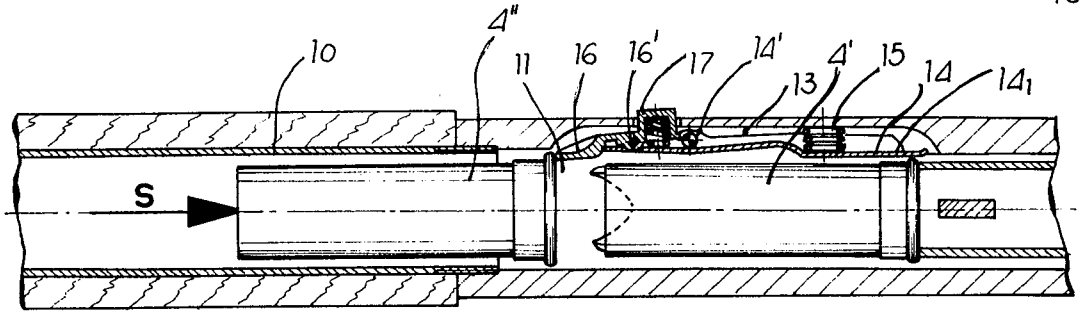
FIG. 6 is a sectional view taken along lines VI—VI of FIG. 5.

The hammer 7, continuing then its run, acts on the firing pin 6, while a fresh cartridge is already positioned on the lift, as it is shown clearly in FIGS. 5 and 6 of the Accompanying Drawings. The cartridge 4' on the lift 12—see FIG. 6—keeps the lever 13 in a position to block the following cartridge 4'' within the magazine 10. On the other hand, tye firing of the cartridge in the barrel causes, as it is known, the retromovement of the breech block 5 with the consequent ejection of the spent casing, the recocking of the hammer and the rising of the lift (urged by the advancement of the breech block), to bring the cartridge 4' on the lift and deliver it toward the cartridge chamber 3, thus returning to the original condition of the firing cycle, corresponding to that shown in FIGS. 1 and 2 of the drawings. This is so, because the hammer's recocking allows the sliding member 18 to displace forward again for engaging with and blocking the lift in an intermediate position.

It is evident from the above description that the recoil of the rifle following the firing of the cartridge has no effect on the feeding of a fresh cartridge, so that the use of the rifle may be carried out with complete reliability and total elimination of void loading of the weapon.

What is claimed is:

1. In a device for the timely feeding of cartridges to semi-automatic rifles comprising a barrel, a cartridge chamber within said barrel, a breech block for opening and closing said cartridge chamber, a firing pin on said breech block, a hammer for striking said firing pin, a catch for engagement with said hammer, a trigger for disengaging said hammer from said catch, a magazine for holding reserve cartridges, spring means for feeding said cartridges from said magazine, a lift for receiving said cartridges one at a time from said magazine and for delivering them to said cartridge chamber, and a composite lever for controlling the passage of said cartridges from said magazine to said lift, the improvement comprising a sliding member, said sliding member being actuated in one direction by a spring and in the opposite direction by said hammer, said sliding member cooperating with said lift so as to positioning it to receive from said magazine a fresh cartridge in advance of the striking of said firing pin by said hammer.

2. The improvement according to claim 1, wherein said sliding member is urged by said spring means toward a rear portion of said lift and is further urged by said hammer away from said rear portion of said lift, respectively.

3. The improvement according to claim 2, wherein said sliding member is axially guided and is provided with a terminal beak for engagement with said rear portion of said lift, said sliding member being further provided with an intermediate tooth for engagement with a countertooth provided on said hammer.

4. The improvement according to claims 2 or 3, wherein said sliding member, when displaced toward said lift, is capable of engaging with its terminal beak the rear portion of said lift, so as to keep said lift intermediately elevated and impeding the passage of cartridges from the magazine to the feed chamber, and when said sliding member is displaced away from said lift, is capable of lowering said lift in position of receiving fresh cartridges from the magazine, in advance of the striking of the firing pin by the hammer.

* * * * *